US012108924B1

(12) United States Patent
Xing et al.

(10) Patent No.: US 12,108,924 B1
(45) Date of Patent: Oct. 8, 2024

(54) ROLLER BRUSH, FLOOR BRUSH HEAD, BRUSH BRISTLE STRUCTURE, AND VACUUM CLEANER

(71) Applicant: Yida Electric Technology (Suzhou) Co., LTD, Suzhou (CN)

(72) Inventors: Tianbo Xing, Suzhou (CN); Jundong Xing, Suzhou (CN)

(73) Assignee: Yida Electric Technology (Suzhou) Co., LTD, Suzhou (CN)

( * ) Notice: Subject to any disclaimer, the term of this patent is extended or adjusted under 35 U.S.C. 154(b) by 0 days.

(21) Appl. No.: 18/746,469

(22) Filed: Jun. 18, 2024

(30) Foreign Application Priority Data

Apr. 8, 2024 (CN) ..... 202410414939.6

(51) Int. Cl.

| | |
|---|---|
| ***A47L 9/04*** | (2006.01) |
| ***A46B 9/02*** | (2006.01) |
| ***A46B 13/00*** | (2006.01) |
| ***A47L 9/06*** | (2006.01) |
| ***A47L 11/40*** | (2006.01) |

(52) U.S. Cl.
CPC ..... *A47L 9/0477* (2013.01); *A46B 9/02* (2013.01); *A46B 13/001* (2013.01); *A47L 9/0606* (2013.01); *A47L 9/0613* (2013.01); *A47L 11/4041* (2013.01)

(58) Field of Classification Search
CPC .... A47L 9/0477; A47L 9/0606; A47L 9/0613; A47L 11/4041; A46B 9/02; A46B 13/001
See application file for complete search history.

(56) References Cited

U.S. PATENT DOCUMENTS

| | | | |
|---|---|---|---|
| 2017/0303676 | A1 | 10/2017 | Goetz et al. |
| 2017/0311767 | A1 | 11/2017 | Fang |
| 2021/0401256 | A1 | 12/2021 | Xu et al. |

FOREIGN PATENT DOCUMENTS

CN 117137387 A * 12/2023 ..... A47L 11/4041

OTHER PUBLICATIONS

CNIPA, Notification to grant patent right for Chinese application CN202410414939.6, May 14, 2024.

* cited by examiner

*Primary Examiner* — David Redding
(74) *Attorney, Agent, or Firm* — Hemisphere Law, PLLC; Zhigang Ma

(57) ABSTRACT

The present disclosure discloses a roller brush, a floor brush head, a brush bristle structure, and a vacuum cleaner. The roller brush of the present disclosure includes a roller brush substrate, at least one group of first cleaning slots arranged in group are formed in the roller brush substrate, the number of first cleaning slots in each group arranged in group is at least three, and the first cleaning slots in each group are close to one another. Actions of the cleaning members do not interfere with one another, especially, during surface cleaning for a carpet and the like, dust scrabbled by the first cleaning member in one group can be effectively scraped away by the second cleaning member arranged in the same group and close to the first cleaning member and cannot be beaten into the carpet again.

20 Claims, 16 Drawing Sheets

ROLLER BRUSH, FLOOR BRUSH HEAD, BRUSH BRISTLE STRUCTURE, AND VACUUM CLEANER

FIELD

The present disclosure relates to the technical field of vacuum cleaners, in particular to a roller brush, a floor brush head, a brush bristle structure, and a vacuum cleaner.

BACKGROUND OF THE INVENTION

A vacuum cleaner has been a standard tool for cleaning floors, carpets or floor tiles in households and companies internationally and domestically. With social development and change, many countries, especially developed countries, have higher and higher cleaning requirements for the vacuum cleaner, so the vacuum cleaner has been evolved to wireless from wired, which results in that suction force of a wireless vacuum cleaner is not comparable to that of a wired vacuum cleaner essentially. Thus, in order to improve cleaning efficiency of a wireless portable vacuum cleaner, efforts have to be made to work only on a brush head. The brush head of the vacuum cleaner is the most core part of the vacuum cleaner for achieving a good effect in various use scenes, for example, a bristle brush made of a soft material needs to be used for floors, floor tiles and cement floors; and as dust on the carpets is stuck into carpet fluffy seams and cannot be cleaned away completely by using the soft bristle brush. Thus, a brush head of a hard bristle brush needs to be substituted or purchased, which virtually leads to increase of purchase cost and complexity of replacement for a user.

An existing vacuum cleaner needs to select different floor brush heads in different use scenes, a soft brush head can be used only for scenes of hard smooth floors such as floors and floor tiles, and a vacuum cleaner with a hard brush head has to be substituted in the case of being used for the carpets. However, the vacuum cleaner with the hard brush head cannot be used for the floors, because hard brush strips of an electric brush head rotate at a high speed and then grind off a degree of finish of the floors and may scratch the floors after frequent use.

Thus, how to make a floor brush head of the same vacuum cleaner capable of meeting demands in various different scenes and skip the trouble of switching the soft brush head and the hard brush head of a vacuum cleaner head is a technical problem urgent to be solved in the industry of vacuum cleaners.

Though there has been a vacuum cleaner to meet cleaning demands of different cleaned surfaces by arranging various different cleaning members (such as leather strips and brush bristles) on a floor brush head at present, mounting slots for arranging cleaning members on the existing vacuum cleaner are usually arranged in a mode of being uniformly distributed in a circumferential direction of a roller brush substrate, and a space between the two adjacent mounting slots is large, so the adjacent cleaning members cannot effectively cooperate and then dust removing effects of the cleaning members interfere with one another and have an unfavorable influence. For example, during cleaning of a soft surface such as the carpet, as the space between arrangement positions of the mounting slots is large or a cooperating effect of the adjacent cleaning members cannot be achieved, a situation that dust beaten out of the carpet by the last cleaning member may be beaten into the carpet again due to a long distance between the last cleaning member and another cleaning member adjacent thereto, or cannot be cleaned away in time may be caused.

SUMMARY OF THE INVENTION

For overcoming the above defects, a first objective of the present disclosure is to provide a roller brush, including a roller brush substrate, at least one cleaning member mounting portion is arranged on the roller brush substrate, each cleaning member mounting portion includes at least one group of first cleaning slots arranged in group, the first cleaning slots are configured to arrange cleaning members, the number of the first cleaning slots in each group arranged in group is at least three, the first cleaning slots in each group are close to one another, and a space d between slot walls close to each other of any two adjacent first cleaning slots in each group does not exceed 18 mm. In the case that the number of groups of first cleaning slots is one, an angle difference β between central axes of any two adjacent first cleaning slots in each group of first cleaning slots arranged in group on a circumferential surface located on the same cylinder using a central axis of the roller brush substrate as a circle center is less than 360/n, wherein n is the number of the first cleaning slots in each group arranged in group. In the case that the number of groups of first cleaning slots is greater than or equal to two, an angle difference a between two first cleaning slots close to each other of any two adjacent groups of first cleaning slots is greater than the angle difference β between the two first cleaning slots close to each other in each group.

The roller brush of the present disclosure has the following beneficial effects.

① By making the first cleaning slots in each group close to one another, the cleaning members in the same group of first cleaning slots can effectively achieve the effect of cooperating with one another. The cleaning members arranged in the same group of first cleaning slots can sequentially pass through the approximately same position of a to-be-cleaned surface in very short time when the roller brush substrate rotates, so actions of the cleaning members do not interfere with one another, especially, during surface cleaning for a carpet and the like, dust scrabbled by the first cleaning member in one group can be effectively scraped away by the second cleaning member arranged in the same group and close to the first cleaning member and cannot be beaten into the carpet again, and a to-be-cleaned area can be cleaned efficiently in time under intensive and compact cleaning of subsequent other cleaning members arranged in the same group.

② By arranging the number of the first cleaning slots in each group arranged in group to be at least three, so by arranging the cleaning members for flapping the carpet to be fluffy in the third first cleaning slot and the first cleaning slot following the third first cleaning slot in each group, an effect of making the cleaned carpet fluffy is achieved, and thus the surface of the cleaned carpet is soft. Besides, complementation with cleaning effects of the cleaning members in the first cleaning slots and the second first cleaning slots may also be achieved, so dirt that is not cleaned away completely by the previous cleaning member touching the to-be-cleaned surface first is effectively cleaned away.

Further, at least one cyclone groove is further formed in a surface of the roller brush substrate, at least one of two first cleaning slots located on an outermost side in each group of first cleaning slots is adjacent to the cyclone groove, an internal groove wall of one side of the cyclone groove away from the central axis a of the roller brush substrate is a large-diameter groove wall, an internal groove wall of one side of the cyclone groove close to the central axis a is a small-diameter groove wall, and a distance D between cylindrical surfaces on which the large-diameter groove wall and the small-diameter groove wall are located along a section perpendicular to a and in a radial direction of the roller brush substrate is greater than 2 mm. During cleaning of mixed dirt of hair and dust on the floor, the mixed dirt of the hair and the dust has large adhesion force between them and a large gravity, so the hair moves in a direction away from the roller brush through arrangement of the cyclone groove, and can be sucked away directly from a dust suction opening. For hair that is not completely separated from the roller brush under an action of the cyclone groove, due to adhesion of the dust and the like, part of hair ends is still stuck to the carpet or the floor, by arranging the first cleaning slots close to the cyclone groove, the hair can be fully scraped out of a surface of the carpet or the floor by the cleaning members in the first cleaning slots, action force away from the roller brush substrate is applied to the hair under the action of the cyclone groove, and thus it is guaranteed that the hair can be sucked away effectively.

More further, two sides of the two first cleaning slots on the outermost side in each group of first cleaning slots are each provided with one cyclone groove, and the large-diameter groove wall is arranged on one side close to the first cleaning slot adjacent to the large-diameter groove wall. Thus, the hair and the like gathered and entangled towards an area of the cleaning members can be reduced to the maximum degree.

More further, the roller brush further includes at least one group of second cleaning portion, each group of second cleaning portion includes two second cleaning slots distributed on the roller brush substrate at an angle difference of 180 degrees, and a distance between the second cleaning slots and the first cleaning slots close to the second cleaning slots is greater than a distance between two adjacent first cleaning slots in each group arranged in group. Thus, through cleaning members arranged in the second cleaning slots, in a rotation process of the roller brush, a certain effect of improving a vacuum degree is achieved between the dust suction opening and the cleaning member close to the ground, and a large blank area, namely, an "air leak" area, is prevented from being formed when a diameter of the roller brush is large and the distance between the two adjacent groups of first cleaning slots is too large.

More further, protrusions protruding outwards away from a surface of the roller brush substrate are further arranged between any two groups of first cleaning slots. Thus, under guiding of the protrusions, the hair is helped to be gathered towards an area of the protrusions and discharged rapidly via the suction opening.

More further, the number of groups of first cleaning slots is an even number, every two groups of first cleaning slots with an angle difference being 180 degrees in a circumferential direction of the roller brush substrate form a cleaning unit, and at least one cleaning unit is arranged on the roller brush substrate. Thus, in this arrangement mode of the 180-degree angle difference, when the roller brush substrate is in rotation, every two groups of first cleaning slots form a dynamic balance state in which the roller brush of a vacuum cleaner conveniently rotates forwards, and shaking or abnormal sound of a floor brush head does not occur.

More further, at least one rubber reduction slot is further formed in the roller brush substrate and is arranged in an area close to the first cleaning slots. By arranging the rubber reduction slot, a weight of the roller brush substrate may be reduced, and thus power consumption during work of a floor brush is reduced.

More further, at least one rubber reduction slot is further formed in the roller brush substrate and is arranged in an area close to at least one of the first cleaning slots and the second cleaning slots.

A second objective of the present disclosure is to provide a floor brush head, including the roller brush aforementioned, at least one type of cleaning members is capable of being arranged in each first cleaning slot, and the cleaning members extend from one end towards the other end in a length direction of a roller brush substrate.

Further, three cleaning members are arranged on a cleaning member mounting portion and are a first cleaning member, a second cleaning member and a third cleaning member in sequence, and in the case that the roller brush is in a rotating state, the three cleaning members arranged on each group of cleaning member mounting portion sequentially rotate towards a to-be-cleaned surface respectively in an order of the first cleaning member, the second cleaning member and the third cleaning member.

More further, the first cleaning member is a hard brush bristle cleaning member, the second cleaning member is a strip-shaped cleaning member, the third cleaning member is a soft brush bristle cleaning member, a hardness of brush bristles of the third cleaning member is less than a hardness of brush bristles of the first cleaning member, and a height of the third cleaning member is equal to or greater than a height of the second cleaning member in the case that a height of the first cleaning member is less than the height of the second cleaning member; and the height of the third cleaning member is greater than the height of the second cleaning member in the case that the height of the first cleaning member is equal to the height of the second cleaning member.

A third objective of the present disclosure is to provide a brush bristle structure, including a first cleaning member, a second cleaning member and a third cleaning member arranged in sequence. When the brush bristle structure is mounted on a roller brush and the roller brush is in a rotating state, the three cleaning members of each group of cleaning member mounting portion sequentially rotate towards a to-be-cleaned surface respectively in an order of the first cleaning member, the second cleaning member and the third cleaning member. The first cleaning member is a hard brush bristle cleaning member, the second cleaning member is a strip-shaped cleaning member, the third cleaning member is a soft brush bristle cleaning member, a hardness of brush bristles of the third cleaning member is less than a hardness of brush bristles of the first cleaning member, a height of the third cleaning member is equal to or greater than a height of the second cleaning member in the case that a height of the first cleaning member is less than the height of the second cleaning member, and the height of the third cleaning member is greater than the height of the second cleaning member in the case that the height of the first cleaning member is equal to the height of the second cleaning member.

A fourth objective of the present disclosure is to provide a vacuum cleaner, including the floor brush head aforementioned or the brush bristle structure aforementioned.

1, cleaning member mounting portion; 11, first cleaning slot; 12, roller brush substrate; 131, first cleaning member; 132, second cleaning member; 133, third cleaning member; 2, cyclone groove; 21, large-diameter groove wall; 22, small-diameter groove wall; 3, second cleaning portion; 31, second cleaning slot; 4, protrusion; 5, rubber reduction groove; and 6, opening container.

DETAILED DESCRIPTION OF THE INVENTION

Preferred examples of the present disclosure are described in detail below with reference to the accompanying drawings, so that advantages and features of the present disclosure are easier to understand by those skilled in the art, and thus the protection scope of the present disclosure is defined more clearly.

Figure 1:
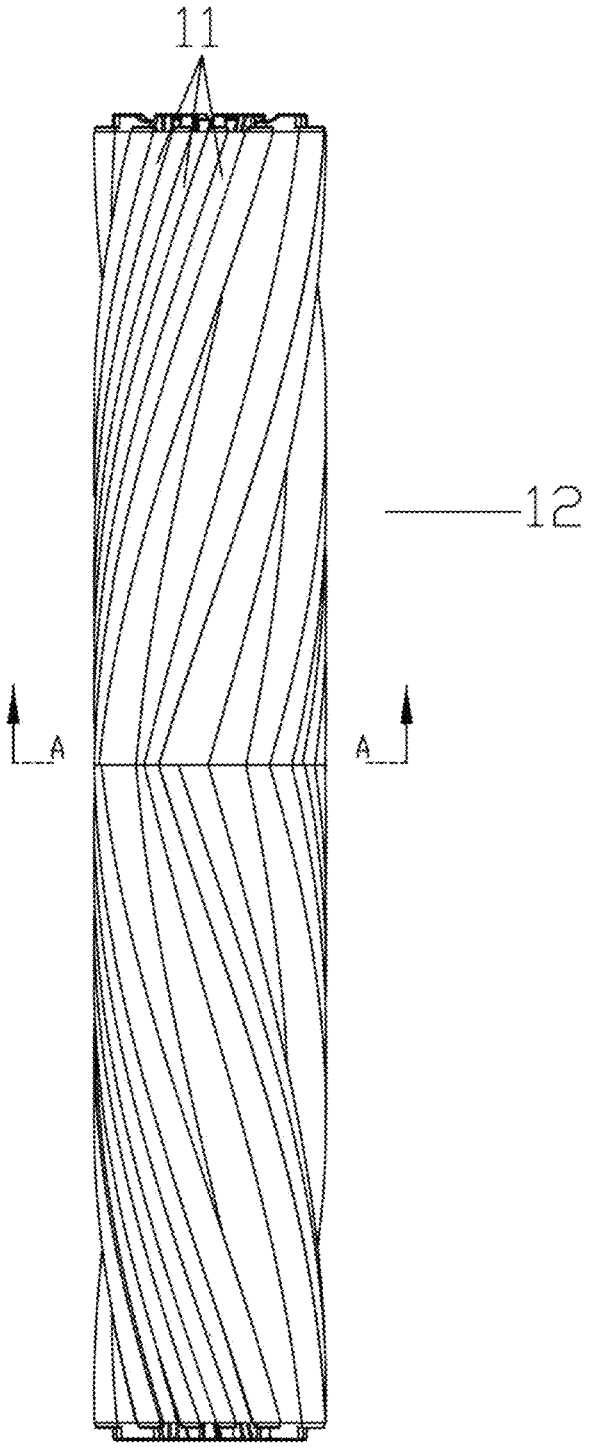
FIG. 1 is a schematic structural top view of a roller brush in an example of the present disclosure.
Figure 2A:
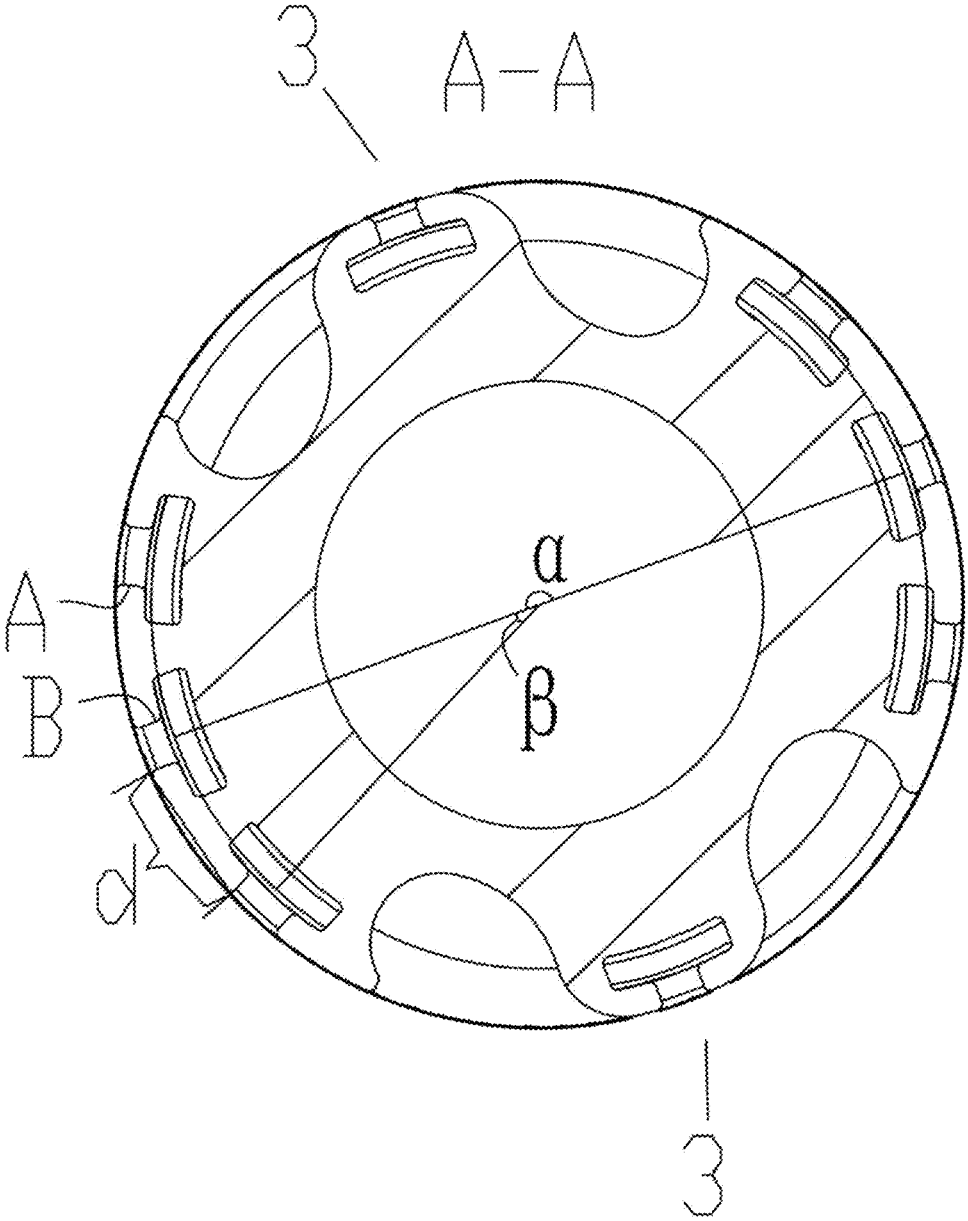
FIG. 2*a* is a sectional view of the roller brush at a viewing angle A-A of FIG. 1.
Figure 2B:
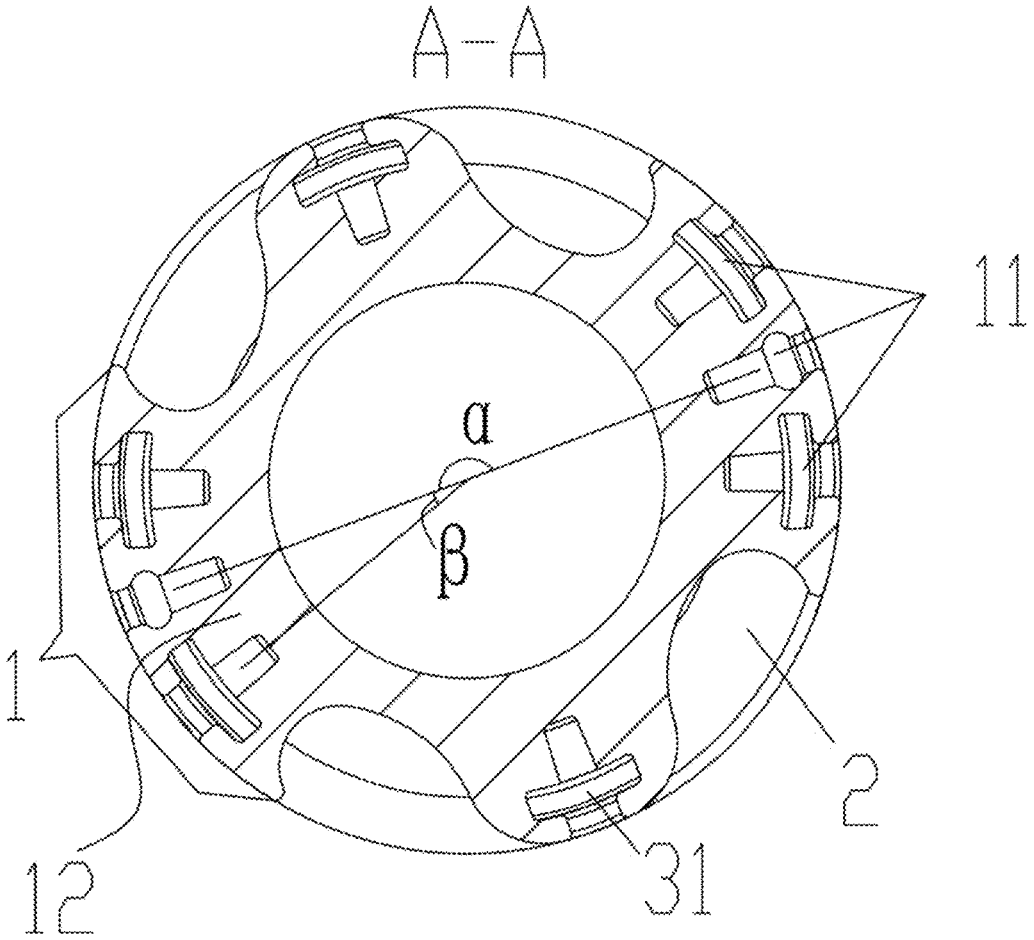
FIG. 2*b* is a sectional view of another roller brush at a viewing angle A-A.

Example 1 referring to FIG. 1 and FIG. 2*b*, this example is a roller brush, including a roller brush substrate 12, and at least one cleaning member mounting portion 1 is arranged on the roller brush substrate 12.

In some implementations, each cleaning member mounting portion 1 includes one group of first cleaning slots 11 arranged in group, the first cleaning slots 11 extend from one end towards the other end in a length direction of the roller brush substrate 12, for example, the first slots may be spiral, V-shaped or arranged in a direction parallel to or oblique from an axis of the roller brush substrate 12, and the first cleaning slots 11 are configured to arrange cleaning members.

Figure 9A:
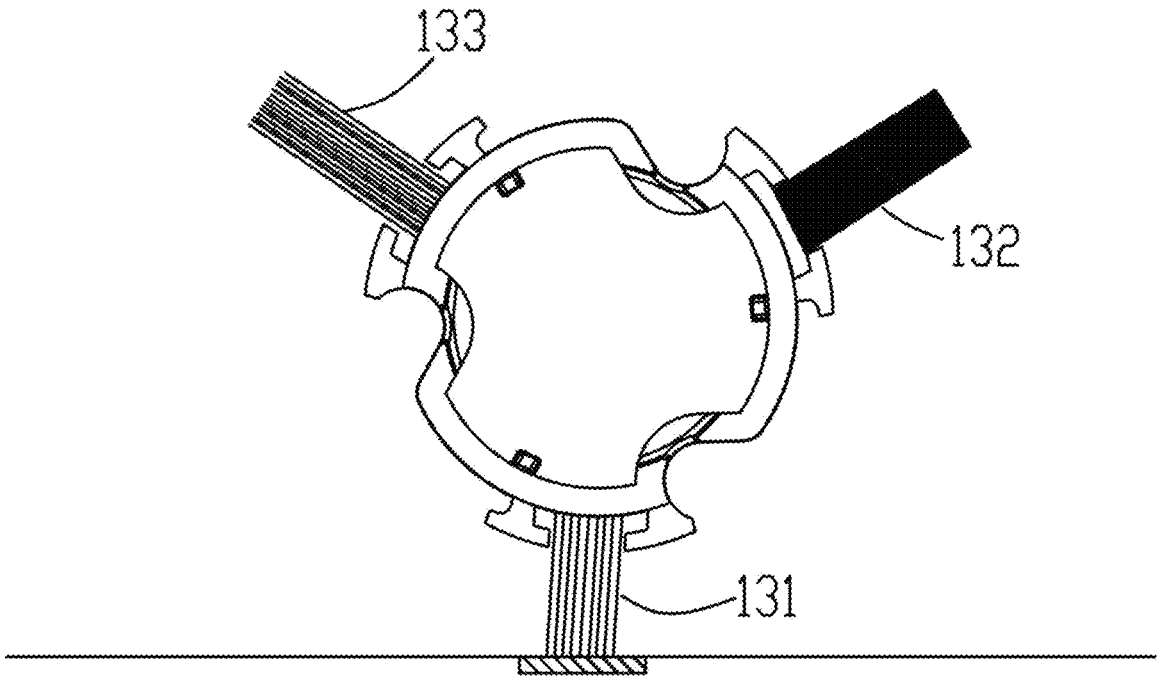
FIG. 9*a* is a schematic diagram of a state when dirt on a carpet such as dust is under cleaning by a first cleaning member in the prior art.
Figure 9B:
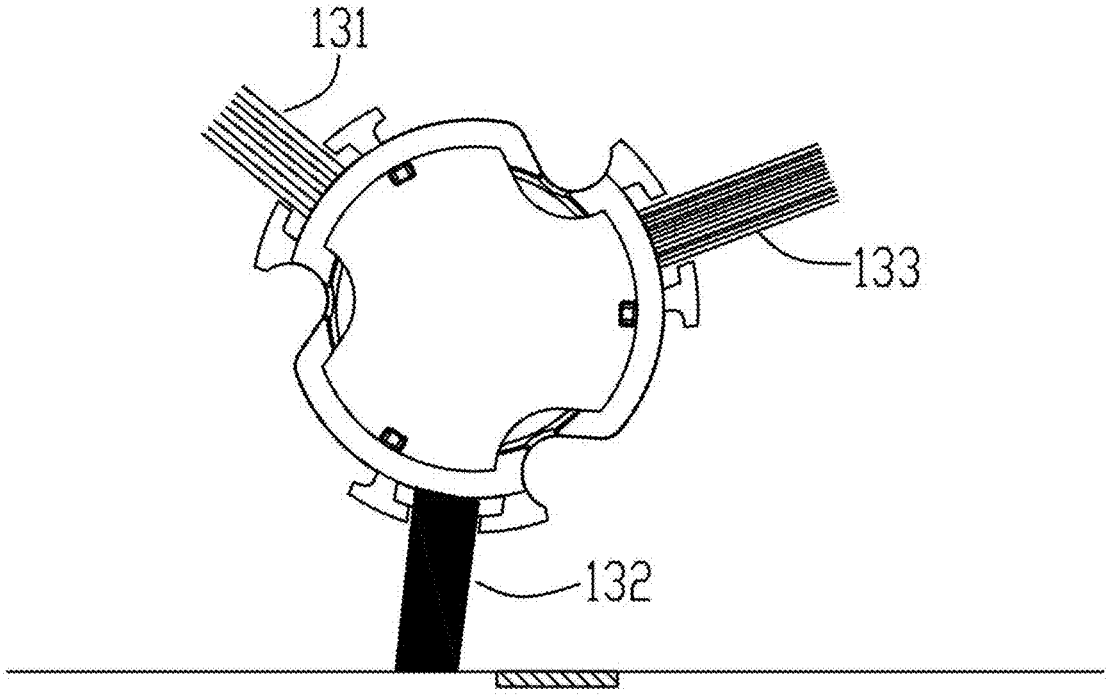
FIG. 9*b* is a schematic diagram of a state when dirt on a carpet such as dust is under cleaning by a second cleaning member in the prior art.

In some implementations, the number of the first cleaning slots 11 in each group arranged in group is three, and the first cleaning slots 11 in each group are close to one another. In the present application, "the first cleaning slots 11 are close to one another" means that an arrangement space between the first cleaning slots 11 in each group in a circumferential direction of the roller brush substrate 12 is small, and a position relationship is approximately that the cleaning members arranged in each group of first cleaning slots 11 arranged in group can sequentially pass through the approximately same position of a to-be-cleaned surface in very short time (such as 0.1 s, 0.3 s, 0.5 s and 0.7 s) when the roller brush substrate 12 is in rotation. This is different from an arrangement mode in the prior art. In the prior art, the first cleaning slots 11 are arranged on a surface of the roller brush substrate 12 in a mode of uniform distribution, though a plurality of groups may be arranged, an arrangement distance between the two adjacent first cleaning slots 11 is longer, so during a rotation process of the roller brush substrate 12, a cleaning area (see FIG. 9*a* and FIG. 9*b*, an area in a rectangular shadow portion in the figures is the cleaning area of the first cleaning member 131) with which the first cleaning member 131 makes a direct contact is not an area where the second cleaning member 132 makes contact with the to-be-cleaned surface, so when dust on a surface such as a carpet needs to be beaten out by the first cleaning member 131 and then sucked away, the second cleaning member 132 cannot effectively cooperate with the first cleaning member 131 and cannot suck away the dust in time, and even a situation that the dust beaten out by the first cleaning member 131 is embedded into the carpet again occurs.

The space d (namely, referring to a space between groove walls close to each other for arranging the cleaning members in the two adjacent first cleaning slots 11, and referring to a chord length distance after the groove wall A and the groove wall B close to each other in the two first cleaning slots 11 close to each other intersect with a circumferential profile of a cross section of the roller brush substrate 12 in FIG. 2*a*) between the groove walls close to each other of any two adjacent first cleaning slots 11 in each group does not exceed 18 mm. In some implementations, d is 4 mm, 6 mm, 8 mm, 10 mm, 12 mm, 13 mm, 14 mm, 15.5 mm, 18 mm or another numerical value.

In the case that the number of groups of first cleaning slots 11 is one and the number of the first cleaning slots 11 is three, an angle difference β between central axes of any two adjacent first cleaning slots 11 in each group of first cleaning slots 11 arranged in group on a circumferential surface located on the same cylinder using a central axis of the roller brush substrate 12 as a circle center is less than 360/3 degrees (namely, β is less than 120 degrees). Namely, the first cleaning slots 11 in each group are generally arranged in a mode of being close to one another, so at least three of the first cleaning slots 11 in each group of first cleaning slots 11 remain a compact design mode, thus functions of the cleaning members in the three first cleaning slots 11 may cooperate with one another, and complementation and support of cleaning functions of the cleaning members in each group arranged in group can be achieved. For example, the first cleaning member 131, the second cleaning member 132 and the third cleaning member 133 are arranged in the three first cleaning slots 11 in sequence in a sequential order of making contact with the ground in a rotation direction of the roller brush. The first cleaning member 131 is a hard brush bristle cleaning member, the second cleaning member 132 is a strip-shaped cleaning member (such as may be leather strips, cloth strips or other sheet-shaped or strip-shaped cleaning members with certain compact surfaces), the third cleaning member 133 is a soft brush bristle cleaning member, and a hardness of brush bristles of the third cleaning member 133 is less than a hardness of brush bristles of the first cleaning member 131.

Figure 7:
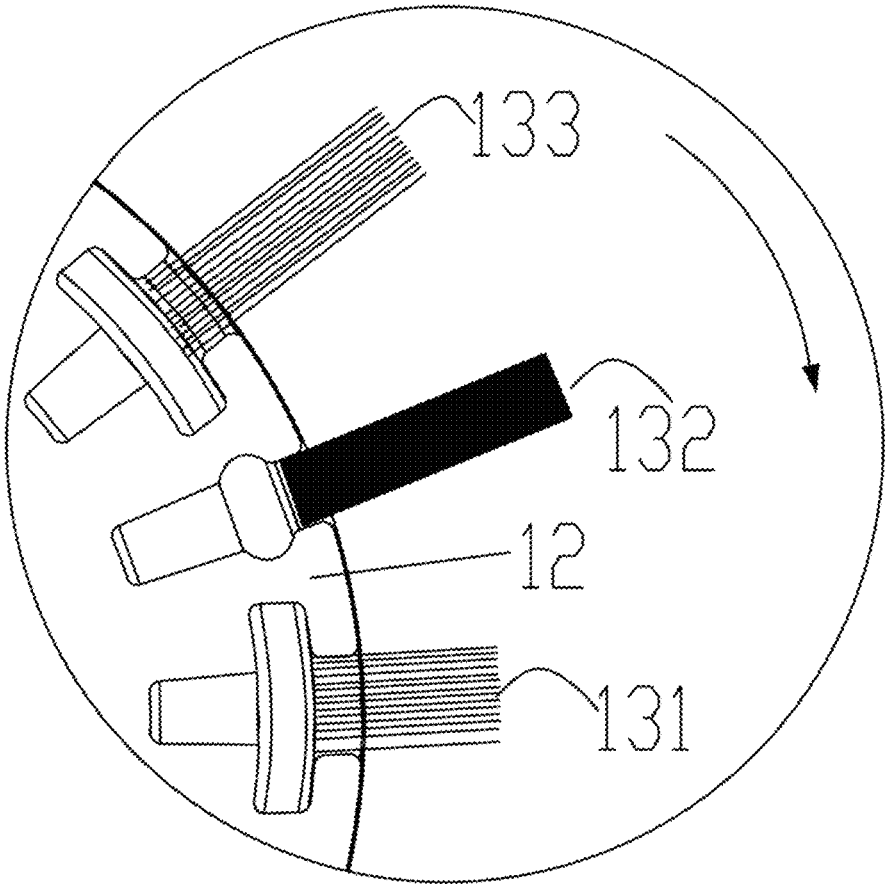
FIG. 7 is a schematic structural diagram of arrangement of a first cleaning member, a second cleaning member and a third cleaning member in Example 1 of the present disclosure.

In an example shown in FIG. 7, a height of the first cleaning member 131 is less than a height of the second cleaning member 132, and a height of the third cleaning member 133 is equal to the height of the second cleaning member 132.

In other possible implementations, the height of the first cleaning member 131 is less than the height of the second cleaning member 132, and the height of the third cleaning member 133 may be greater than the height of the second cleaning member 132.

When a vacuum cleaner cleans a soft surface such as a carpet, the vacuum cleaner is sunken into the soft surface for a certain distance under the action of gravity, at the moment, the first cleaning member 131 with the small height and a hard texture can be first embedded into the carpet and can scrabble sundries such as dust in the carpet, further, the sundries are fully scraped away directly under an action of the second cleaning member 132 close to the first cleaning member 131 and sucked away via a suction opening of the vacuum cleaner, and meanwhile, the scrabbled dust is just filled in a containing space formed by the second cleaning member 132 and the carpet or the floor, and then taken away under rotation of the second cleaning member 132.

Besides, after the soft surface such as the carpet is cleaned by the vacuum cleaner, a problem exists in general that fluff on the carpet surface is pressed by the cleaning members of the vacuum cleaner, and thus attractiveness of the cleaned carpet is reduced. The present disclosure uses soft bristles of the third cleaning member 133 close to the second cleaning member 132, fluff of the carpet pressed by the first cleaning member 131 and the second cleaning member 132 in a cleaning process may be recovered to a fluffy effect under flapping of the soft bristles of the third cleaning member 133 (see FIG. 8*c*), and meanwhile, the third cleaning member 133 is soft brush bristles and can play a cleaning effect again.

Besides, when a hard surface needs to be cleaned, a length of the first cleaning member 131 is small, so the first cleaning member 131 does not make contact with the to-be-cleaned surface in the whole cleaning process, the second cleaning member 132 and/or the third cleaning member which have/has a large length can make contact with the to-cleaned surface, and a texture of the second cleaning member 132 and a texture of the third cleaning member 133 are soft and do not scratch the to-be-cleaned surface. Thus, by using the roller brush provided with the first cleaning member 131, the second cleaning member 132 and the third cleaning member 133 of this example, switching is allowed at will in different application scenes without stopping a machine to replace the cleaning members or the roller brush.

By arranging the first cleaning member 131 to be hard bristles, and the second cleaning member 132 to be a strip-shaped cleaning member, so when the hair exists on the carpet, the hair is embedded into the hard bristles, at the moment, the hard bristles will not collapse or incline too much under a supporting effect of the second cleaning member 132, the hair embedded into the first cleaning member 131 is always in an area close to lower ends of the brush bristles and hardly enters roots of the brush bristles, and thus a probability that the hair is entangled on the first cleaning member 131 can be reduced effectively.

In other possible implementations, the height of the first cleaning member 131 may also be equal to the height of the second cleaning member 132, but at the moment, the height of the third cleaning member 133 is greater than a height of the second cleaning member 132. In this case, when the hard surface needs to be cleaned, as the lengths of the first cleaning member 131 and the second cleaning member 132 are small, the first cleaning member 131 and the second cleaning member 132 do not make contact with the to-be-cleaned surface in the whole cleaning process, and the third cleaning member 133 with the large length can make contact with the to-be-cleaned surface. Thus, in this case, when the hard surface needs to be cleaned, only the third cleaning member 133 can make contact with the hard surface, and switching is allowed at will in different application scenes without stopping a machine to replace the cleaning members.

But if the arrangement mode of not making the first cleaning slots 11 arranged in group close to one another in the prior art is adopted, the three cleaning members cannot cooperate effectively, for example, if a distance between the second cleaning member 132 and the first cleaning member 131 is longer, the second cleaning member 132 cannot just accommodate and scrape away the dust scrabbled by the first cleaning member 131. If a distance between the third cleaning member 133 and the second cleaning member 132 is longer, the fluff on the carpet surface is in a pressed state, though another third cleaning member 133 with the soft texture is arranged in an area farther from the second cleaning member 132, and the third cleaning member can flap part of carpet fluff to be fluffy when rotating to a position nearby an area close to the ground, the fluff pressed by the second cleaning member 132 cannot be just positioned accurately and flapped.

Though a roller brush that is provided with a plurality of groups of cleaning members to reduce the arranged space between the cleaning members also exists in the prior art, the space between any two adjacent cleaning members is equal, so the effect of making the first cleaning slots arranged in group close to one another in the present application is hard to achieve, then too many first cleaning slots need to be arranged on the roller brush substrate, consequently, machining difficulty of the roller brush substrate is high, mechanical strength is reduced, moreover, a working resistance during rotation of a roller brush head is too high, load cost is large, a heating amount of a motor is very high, and the burn-in risk exists.

In other possible implementations, the number of the first cleaning slots 11 in each group arranged in group may be greater than three, such as four, so for arranging the first cleaning slots 11 in the same group to be close to one another, an angle difference β between central axes of any two adjacent first cleaning slots 11 in the first cleaning slots 11 in the same group arranged in group on a circumferential surface located on the same cylinder using a central axis of the roller brush substrate 12 as a circle center is less than 360/4 degrees (namely, β is less than 90 degrees).

In other possible implementations, the number of groups of first cleaning slots 11 arranged in group is two, an angle difference a between two first cleaning slots 11 close to each other of any two adjacent groups of first cleaning slots 11 (namely, the first group of first cleaning slots 11 and the second group of first cleaning slots 11 in FIG. 2*b*) is greater than the angle difference β between the two first cleaning slots 11 close to each other in each group. α is an angle difference of a central axis of the slot in the middle in each group of first cleaning slots 11 respectively along a projection of a section perpendicular to an axial direction of the roller brush substrate 12 shown in FIG. 2*b*.

The first cleaning slots 11 in each group of first cleaning slots 11 are close to one another and arranged densely, the space between the first cleaning slots 11 in each group is relatively large, so the cleaning members correspondingly arranged in each group of first cleaning slots 11 can effectively complete cleaning for surface dirt and the like.

In some implementations, two groups of first cleaning slots 11 with an angle difference being 180 degrees form a cleaning unit, and at least one cleaning unit is arranged on the roller brush substrate 12. In other possible implementations, the number of groups of first cleaning slots 11 arranged in group may also be four, six, eight or another even number.

The angle difference of the two groups of first cleaning slots 11 of each cleaning unit in a circumferential direction of the roller brush substrate 12 is 180 degrees. The two groups of first cleaning slots 11 with the angle difference being 180 degrees form a cleaning unit. Thus, in this arrangement mode of the 180-degree angle difference, when the roller brush substrate 12 is in rotation, every two groups of first cleaning slots 11 just form a dynamic balance state in which the roller brush of the vacuum cleaner conveniently rotates forwards, namely, inertia force formed by one group of first cleaning slots 11 in one cleaning unit during rotation matches inertia force of the other group of first cleaning slots 11 with the 180-degree angle difference therefrom, and therefore, a negative effect caused by an arrangement position of the first cleaning slots 11 to rotation of the roller brush can be reduced to the maximum degree. On the contrary, if the number of groups of first cleaning slots 11 of one cleaning unit is an odd number, inertia force of each group of first cleaning slots 11 in each cleaning unit may offset mutually to a certain degree, and then energy consumption of the vacuum cleaner may be increased virtually.

In some implementations, the cleaning member in each first cleaning slot 11 and the first cleaning slot 11 are mounted detachably. Thus, the cleaning members may be replaced at will according to use demands so as to provide convenience in actual use.

In some implementations, there are at least two types of the cleaning members arranged in each group of first cleaning slots 11.

Figure 2C:
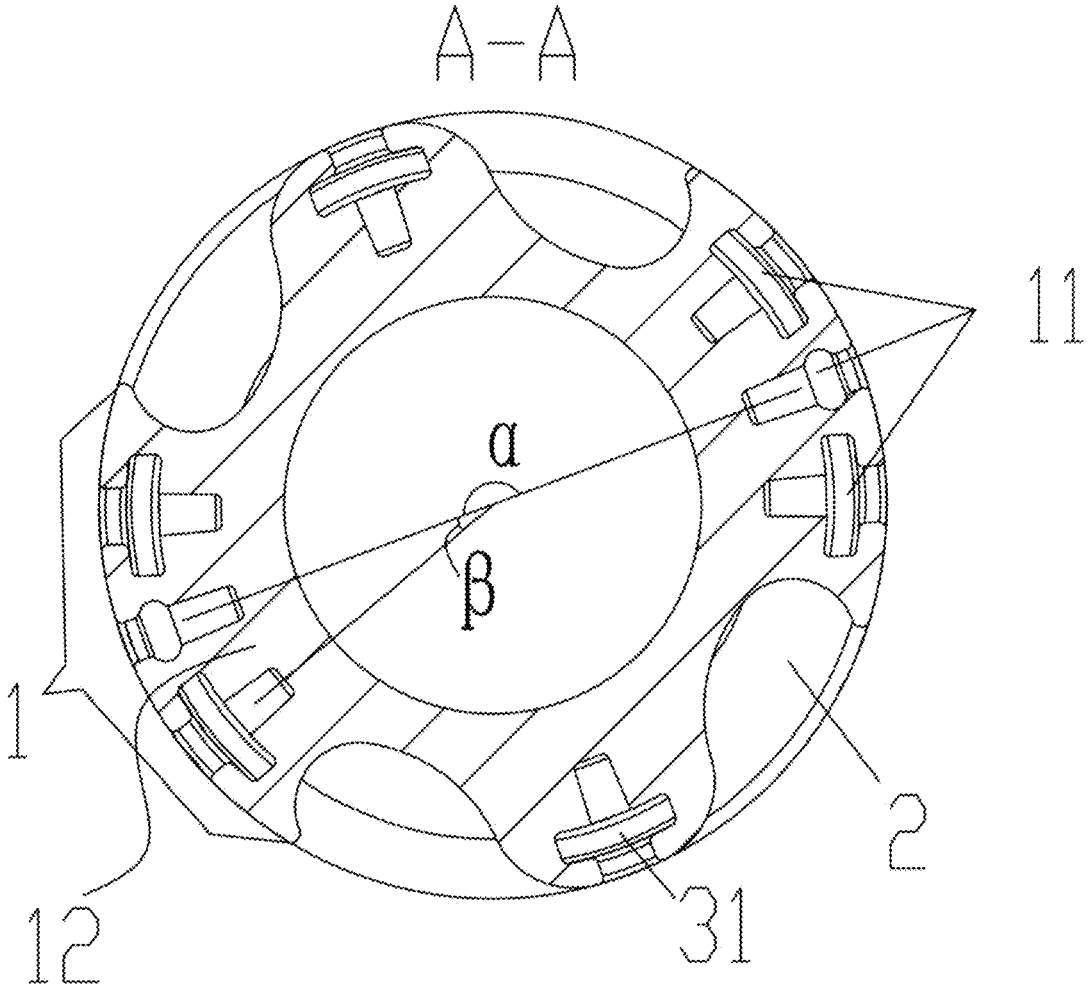
FIG. 2*c* is a sectional view of a roller brush substrate along a section perpendicular to a length direction of the roller brush substrate.

In some implementations, according to the roller brush of the present disclosure, at least one cyclone groove 2 is further formed in the surface of the roller brush substrate 12, and at least one of the two first cleaning slots 11 (for example, the first cleaning slots 11 indicated by solid black arrows in FIG. 2*c*) on the outermost side in each group of first cleaning slots 11 is adjacent to the cyclone groove 2.

Figure 3:
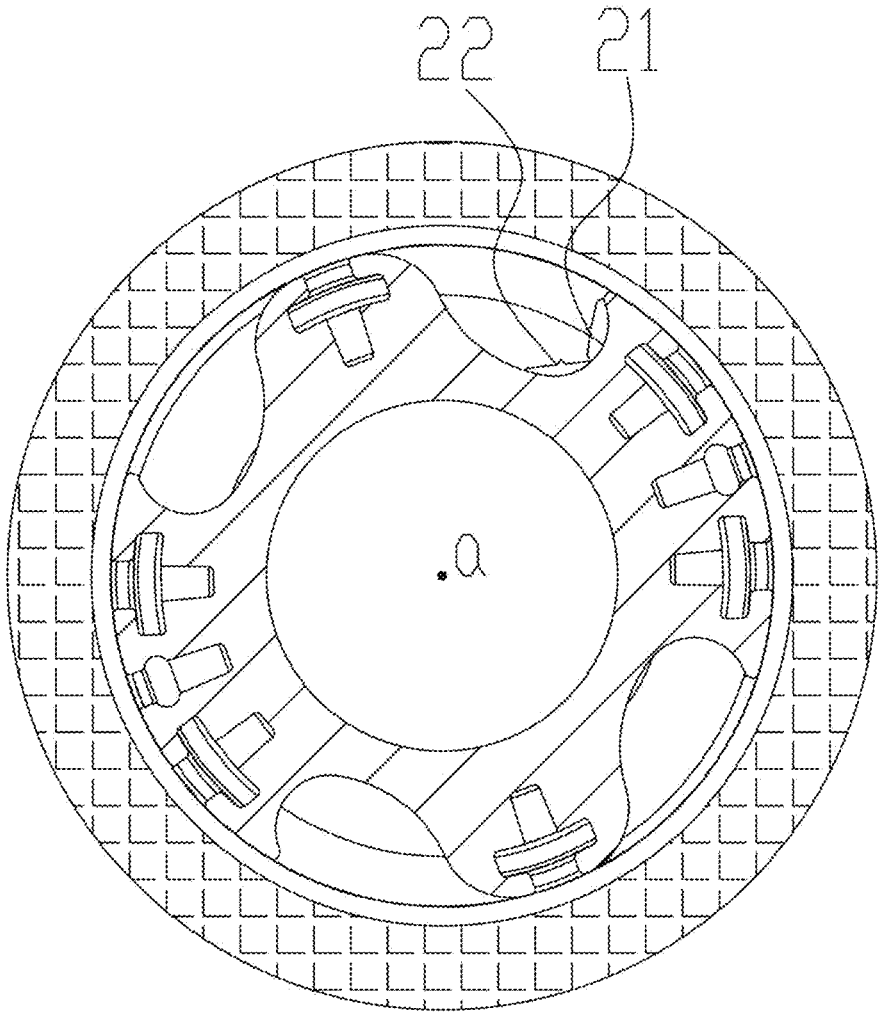
FIG. 3 is a schematic structural diagram of arrangement of a large-diameter groove wall and a small-diameter groove wall of a roller brush substrate in a cyclone groove in Example 1 of the present disclosure.
Figure 4:
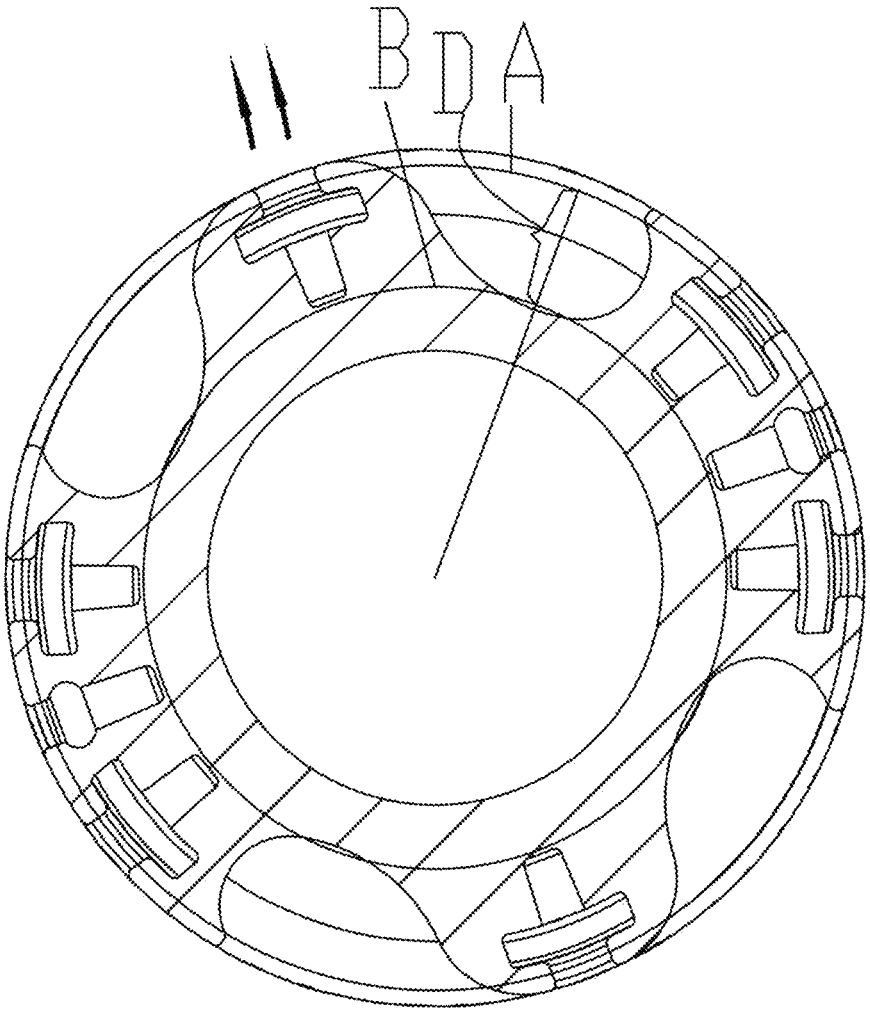
FIG. 4 is a schematic structural diagram of a groove depth of a cyclone groove in Example 1 of the present disclosure.

As shown in FIG. 3 and FIG. 4, an internal groove wall of one side of the cyclone groove 2 away from the central axis a of the roller brush substrate 12 is a large-diameter groove wall 21, and an internal groove wall of one side of the cyclone groove 2 close to the central axis a is a small-diameter groove wall 22; an edge of the large-diameter groove wall 21 away from a is a first edge, at least part of areas of the first edge overlaps with a surface of at least one cylinder with a as an central axis, and an overlapping area is used as a first position; at least part of areas of the small-diameter groove wall 22 in a length direction of a overlaps a surface of a cylinder with a as an central axis, and an overlapping area is used as a second position; and the surface of the cylinder with a as the central axis passing through the first position is used as A, the surface of the cylinder with a as the central axis passing through the second position is used as B, and a distance D between A and B in a direction perpendicular to a and in a radial direction of the substrate is greater than 2 mm.

Thus, through arrangement of the cyclone groove 2, the hair moves in a direction away from the roller brush and is sucked away from the suction opening, and the hair entangled onto the roller brush can be effectively reduced. During rotating dust removal by using the vacuum cleaner with the roller brush of the present disclosure, most of hair and the like float on an area close to an outer surface of the roller brush under guiding of the cyclone groove 2, but mixed dirt of the dust and the hair has large adhesion force between them and a large gravity, so part of hair ends is still stuck to the carpet or the floor, thus the hair is fully scraped out of a surface of the carpet or the floor under the action of the cleaning members in the first cleaning slots 11 close to the cyclone groove 2, action force away from the roller brush substrate is applied to the hair under the action of guiding and cyclone force of the cyclone groove, and thus it is guaranteed that the hair can be sucked away effectively.

In some implementations (as shown in FIG. 3 and FIG. 4), two cyclone grooves 2 arranged reversely are formed between every two groups of first cleaning slots 11 arranged in group. The large-diameter groove wall 21 of the cyclone groove 2 is arranged on one side close to the first cleaning slot 11 adjacent to the large-diameter groove wall. Accordingly, the hair enters the cyclone groove 2 and then is blown out from a middle area (such as a direction indicated by a solid black arrow in FIG. 4) of the two opposite cyclone grooves 2.

In some implementations, the roller brush further includes at least one group of second cleaning portion 3 (with reference to FIG. 2*a* and FIG. 2*b*), and each group of second cleaning portion 3 includes two second cleaning slots 31 distributed on the roller brush substrate 12 at the 180-degree angle difference. A distance between the second cleaning slots 31 and the first cleaning slots 11 close to the second cleaning slots is greater than a distance between two adjacent first cleaning slots 11 in each group arranged in group. Thus, through cleaning members arranged in the second cleaning slots 31, a certain effect of improving a vacuum degree is achieved, and a large blank area, namely, an "air leak" area, is prevented from being formed when a diameter of the roller brush is large and the distance between the two adjacent groups of first cleaning slots 11 is too large. Certainly, if the diameter of the roller brush substrate 12 is small, the second cleaning slots 31 may be not arranged.

A section shape of the second cleaning slot 31 perpendicular to a length direction of the second cleaning slot may be an arc shape (as shown in FIG. 2*c*) or a square shape (as shown in FIG. 2*b*). A section shape of the first cleaning slot 11 may be an arc shape or a square shape.

In other possible implementations, protrusions 4 (a shown in FIG. 5*b*) protruding outwards away from a surface of the roller brush substrate 12 are further arranged between any two groups of first cleaning slots 11. Thus, the hair can be blown away in a direction away from the outer surface of the roller brush substrate 12 under guiding of the protrusions 4.

In some implementations, at least one rubber reduction groove 5 is further formed in the roller brush substrate 12 and is arranged in an area close to the first cleaning slots 11. For meeting arrangement of the plurality of first cleaning slots 11 arranged in group during a machining process, an arrangement thickness of the roller brush substrate 12 has to be increased, a weight of the roller brush substrate 12 may be reduced by arranging the rubber reduction groove 5, and then power consumption during work of a floor brush is reduced.

Figure 5A:
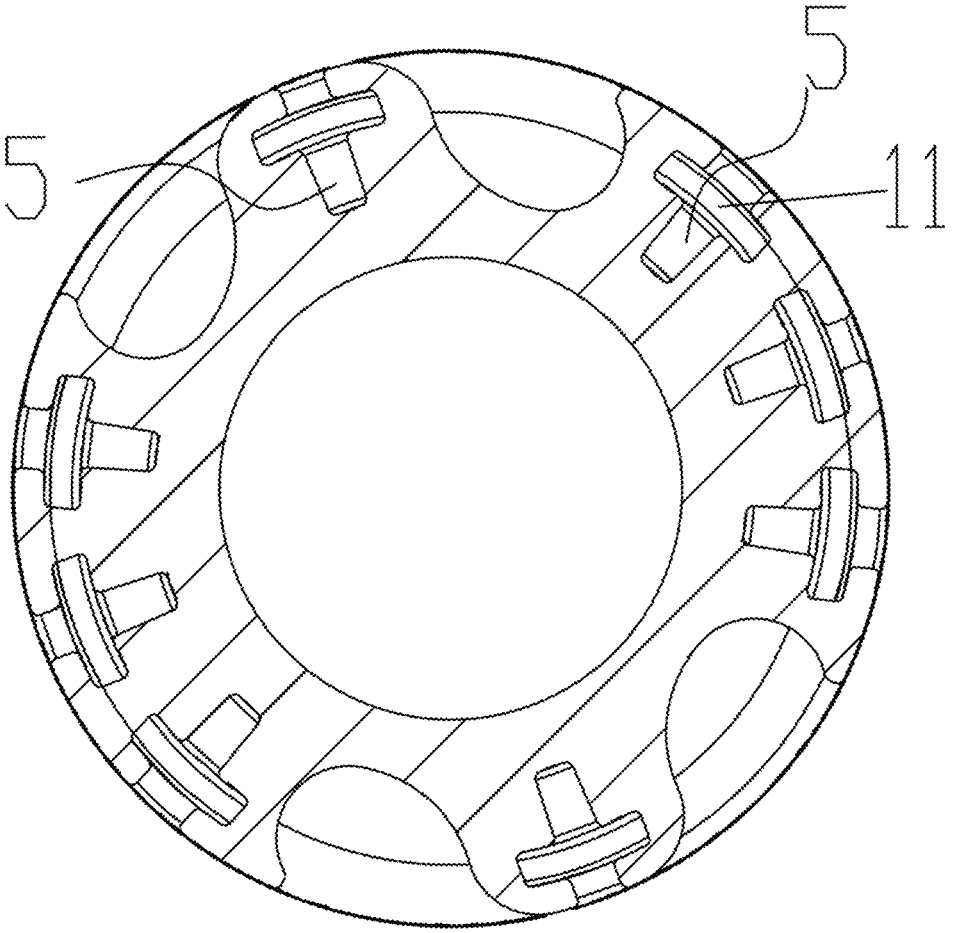
FIG. 5*a* is a schematic structural diagram of arrangement of a rubber reduction groove in Example 1 of the present disclosure.
Figure 5B:
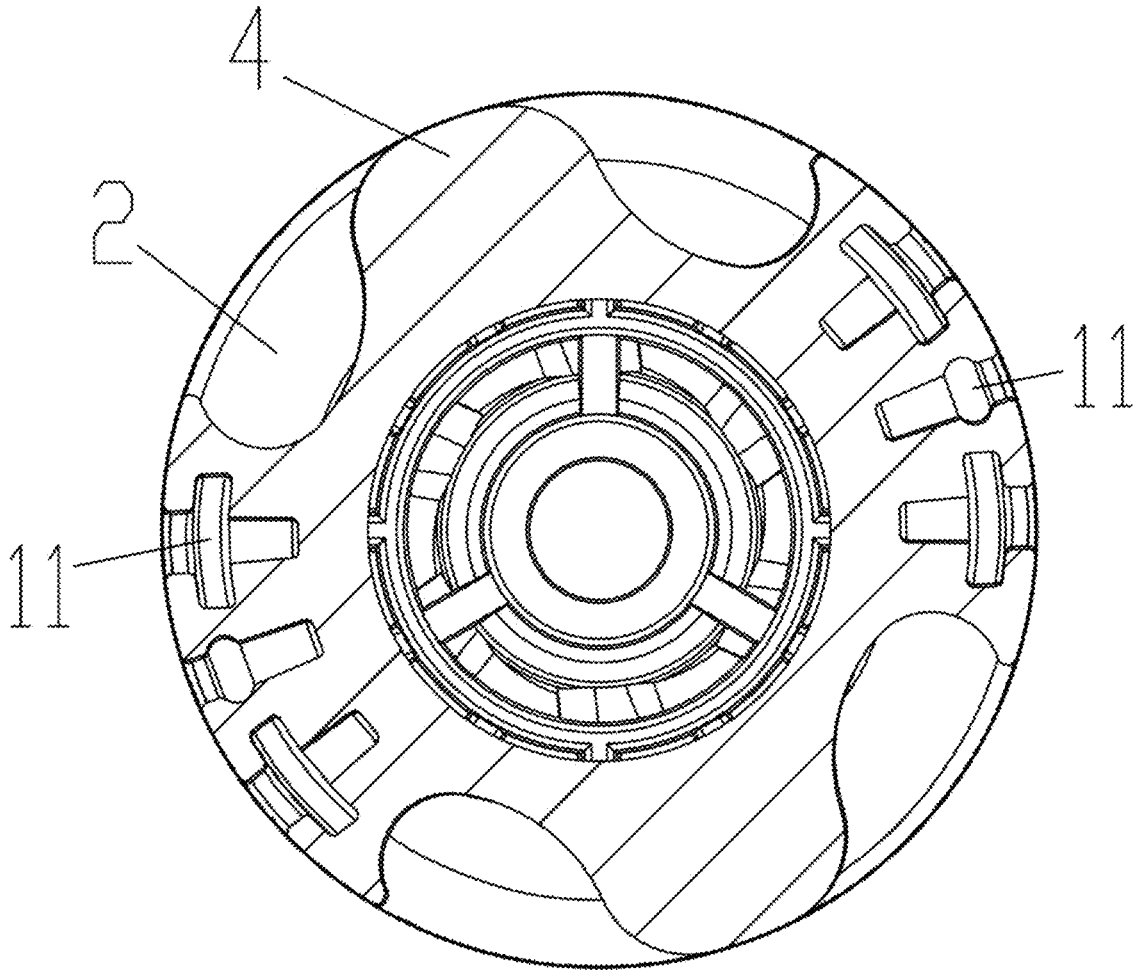
FIG. 5*b* is a schematic structural diagram of arrangement of a protrusion in Example 1 of the present disclosure.
Figure 6:
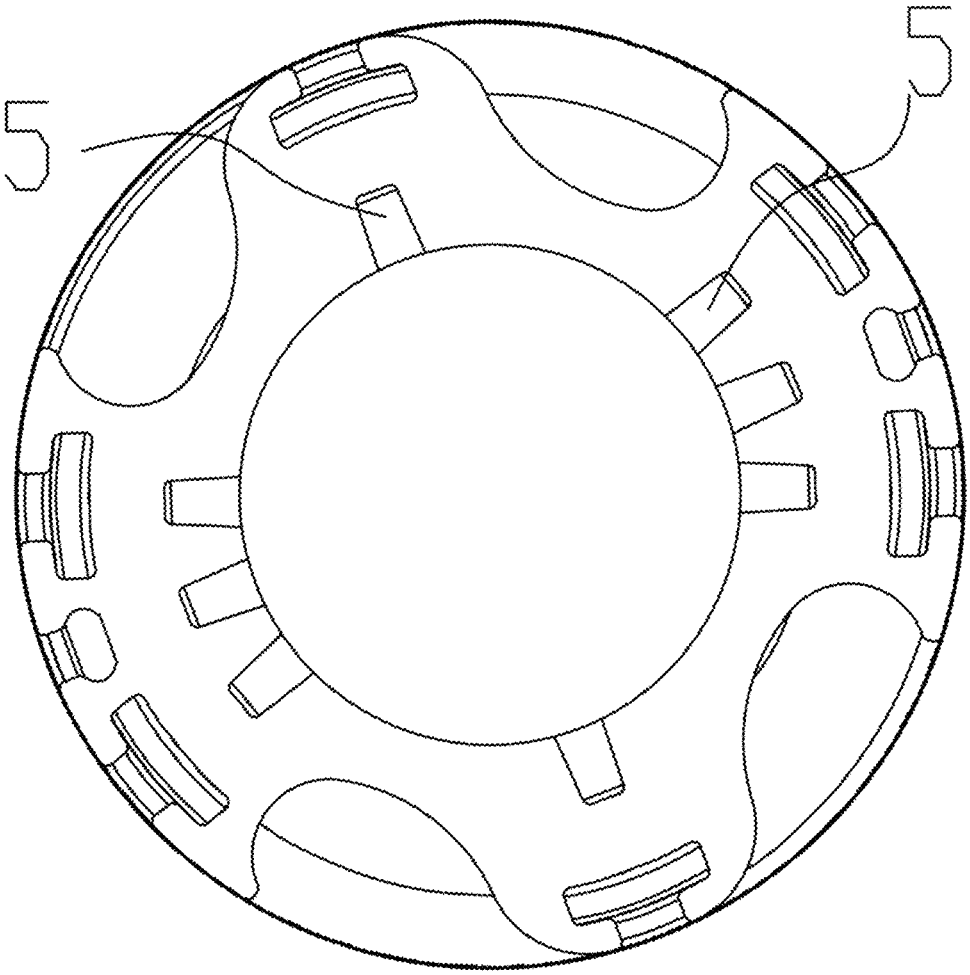
FIG. 6 is a schematic structural diagram of another arrangement of a rubber reduction groove in Example 1 of the present disclosure.

As shown in FIG. 5*a*, in some implementations, the rubber reduction groove 5 communicates with the first cleaning slots 11 or the second cleaning slots 31, so the rubber reduction groove is convenient to directly machine during the machining process of the first cleaning slots 11 or the second cleaning slots 31. As shown in FIG. 6, the rubber reduction groove 5 may be hollowed out in a direction away from an axial center of the roller brush substrate 12 along a hollow internal surface area arranged in an axial direction of the roller brush substrate 12, but the rubber reduction groove 5 does not communicate with the first cleaning slots 11 or the second cleaning slots 31, the rubber reduction groove 5 is arranged in an area close to an axial center of the roller brush substrate 12 and away from the outer surface of the roller brush substrate 12, and thus accumulation of dirt and the like in the rubber reduction groove can be reduced.

The rubber reduction groove 5 may be arranged in an area not close to the first cleaning slots 11 and/or the second cleaning slots 31.

In some implementations of the present disclosure, at least one type of the cleaning members is capable of being arranged in each first cleaning slot 11, and the cleaning member extends from one end towards the other end in a length direction of the roller brush substrate 12. Arrangement directions of the cleaning members mounted in the same group of first cleaning slots 11 are consistent. Thus, the cleaning members arranged in group better cooperate with one another.

The first cleaning slots 11 may be spiral, V-shaped or arranged in a direction parallel to or inclining from an axis of the roller brush substrate 12, and the cleaning members may be leather strips, furry strips, cloth strips, paper strips, brush bristles or soft strips (cloth strips, rubber strips, non-woven strips or a cloth and leather mixed material), etc.

As shown in FIG. 7, in some implementations of the present disclosure, each cleaning member mounting portion 1 is provided with the three cleaning members which are the first cleaning member 131, the second cleaning member 132 and the third cleaning member 133 in sequence, and when the roller brush is in a rotating state, the three cleaning members of each group of cleaning member mounting portion 1 sequentially rotate towards a to-be-cleaned surface (a direction indicated by an arrow in FIG. 7, namely, a rotating direction of a rolling brush during work) respectively in an order of the first cleaning member 131, the second cleaning member 132 and the third cleaning member 133.

In some implementations of the present disclosure, the first cleaning member 131 is the hard brush bristle cleaning member, the height of the first cleaning member 131 is less than the height of the second cleaning member 132 or the third cleaning member 133, the second cleaning member 132 is a strip-shaped cleaning member, for example, may be leather strips, cloth strips or other sheet-shaped or strip-shaped cleaning members with certain compact surfaces, the third cleaning member 133 is the soft brush bristle cleaning member, and the hardness of the brush bristles of the third cleaning member 133 is less than the hardness of the brush bristles of the first cleaning member 131. The soft bristles of the first cleaning member 131 of the present disclosure refer to bristles without a prickled touch feeling and with a small bristle diameter, such as 0.01 mm to 0.1 mm, specifically, 0.01 mm, 0.03 mm, 0.04 mm, 0.07 mm, or 0.09 mm, etc. The hard bristles of the present disclosure refer to bristles with a hard touch feeding in whole and a bristle diameter being 0.05 mm to 0.4 mm, specifically, 0.05 mm, 0.07 mm, 0.085 mm, 0.125 mm, 0.23 mm, 0.28 mm, 0.375 mm, 0.4 mm, etc.

Figure 8A:
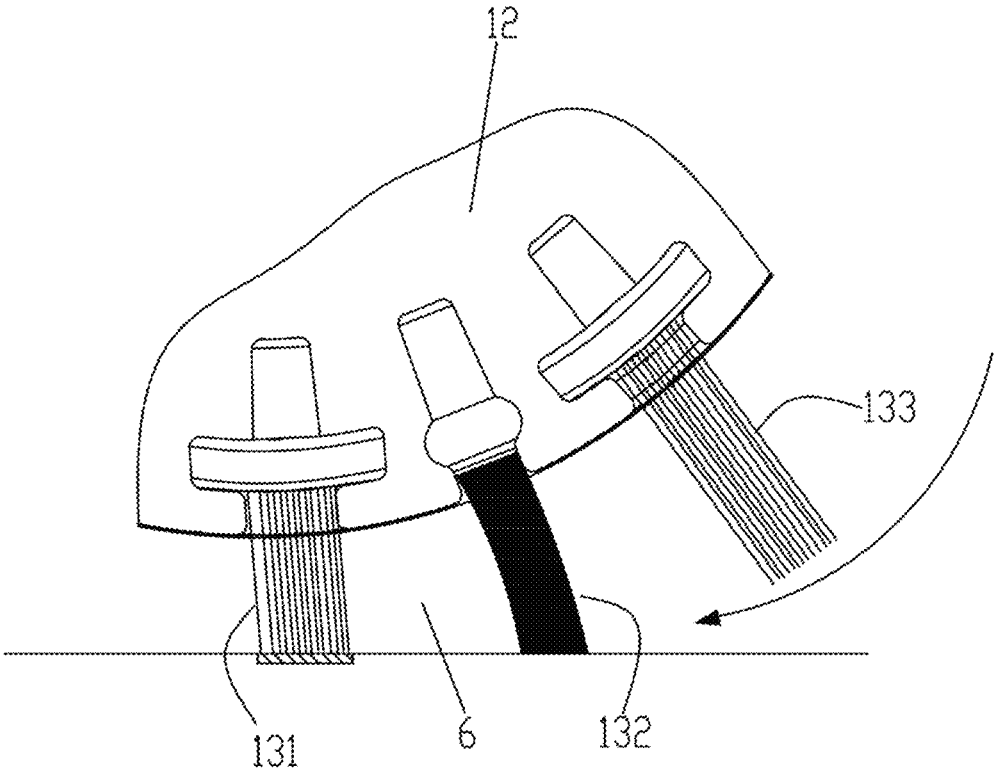
FIG. 8*a* is a schematic diagram of a state when dirt on a carpet such as dust is scrabbled by a first cleaning member.
Figure 8B:
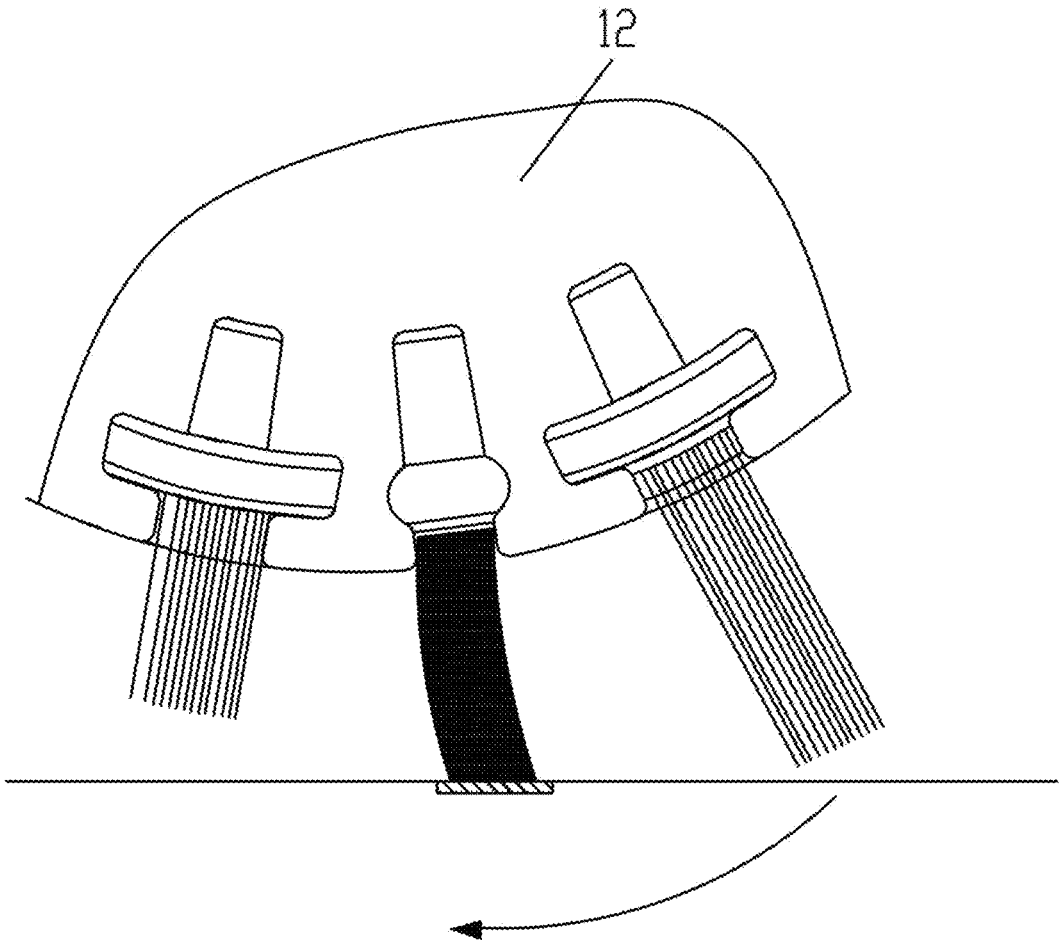
FIG. 8*b* is a schematic diagram of a state when dirt on a carpet such as dust is scraped away by a second cleaning member.
Figure 8C:
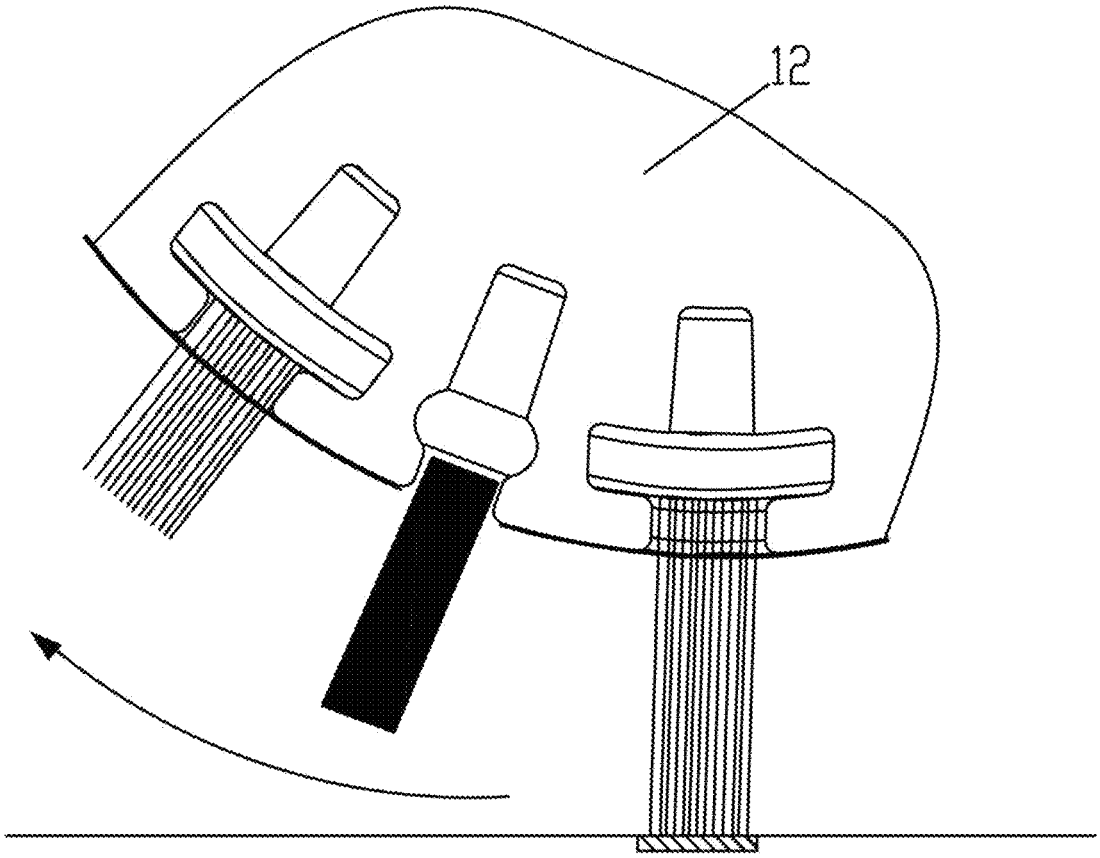
FIG. 8*c* is a schematic diagram of a state when a cleaned carpet is flapped by a third cleaning member.

Thus, as shown in FIG. 8*a*, FIG. 8*b* and FIG. 8*c*, during cleaning of the soft surface such as the carpet by the vacuum cleaner, the first cleaning member 131 with the hard texture is first embedded into the carpet and can scrabble the sundries such as dust embedded into the carpet (as shown in FIG. 8*a*), at the moment, part of dust is directly scrabbled out in a direction towards the dust suction opening (the dust suction opening is arranged in a direction of a left side of FIG. 8*a*) under the action of the first cleaning member 131 and sucked away under suction force of the vacuum cleaner.

Afterwards, along with continuous rotation of the roller brush, in the process of the second cleaning member 132 continuously rotating in a direction towards the dust suction opening, the scrabbled dust and the like are further fully scraped away under scraping of the second cleaning member 132 and sucked away via the suction opening of the vacuum cleaner with continuous rotation of the second cleaning member 132. Meanwhile, the scrabbled dust is just filled in a containing space formed by the second cleaning member 132 and the carpet or the ground and taken away under rotation of the second cleaning member 132. By adopting the arrangement mode of the cleaning members in which the hard bristles are for scrabbling first and then the strip-shaped cleaning member is for scraping, not only can a better sealing effect of the strip-shaped cleaning member be utilized, but also it is guaranteed that the dust scrabbled out by the first cleaning member 131 is efficiently sucked away. Compared with ordinary brush bristles, when the strip-shaped cleaning member rotates to a position close to the to-be-cleaned surface, the strip-shaped cleaning member can form a structural form similar to "opening container 6" due to its relatively hard texture and fully guide the dust into the "opening container 6" (as shown in FIG. 8*a*), meanwhile, the strip-shaped cleaning member has a better scraping effect on the ground or the carpet and thus can fully guide the dust scrabbled out by the first cleaning member 131 into the dust suction opening of the vacuum cleaner.

Besides, by adopting the soft bristles of the third cleaning member 133 in the present disclosure, the fluff of the carpet pressed in the cleaning process of the first cleaning member 131 and the second cleaning member 132 can be recovered to a fluffy effect under flapping of the soft bristles of the third cleaning member 133 (as shown in FIG. 8*c*, a transverse line arranged in a horizontal direction in FIG. 8*a*, FIG. 8*b* and FIG. 8*c* is illustration of a surface of the carpet and the like, and part of areas of a rectangular shadow arranged on the carpet is an area in which each cleaning member makes contact with the surface of the carpet). Thus, after dust removal by using the roller brush of the present disclosure, appearance of the carpet is softer and more comfortable.

The arrangement mode of making the first cleaning slots close to one another in this example is used, and the three cleaning members in each group of first cleaning slots are arranged as the hard brush bristle cleaning member, the strip-shaped cleaning member and the soft brush bristle cleaning member in the aforementioned mode respectively. Heights of the cleaning members in each example are arranged as follows.

In Example 1 of the present disclosure: the height of the first cleaning member 131 is less than the height of the second cleaning member 132, and the second cleaning member 132 is the same height as the third cleaning member 133.

In Example 2 of the present disclosure: the first cleaning member 131 has the same height as the second cleaning member 132 but has the height less than the height of the third cleaning member 133.

In Example 3 of the present disclosure: the heights of the first cleaning member 131, the second cleaning member 132 and the third cleaning member 133 increase in sequence.

The height of the first cleaning member 131 in each example above can guarantee not to make contact with the floor during cleaning of the hard floor, but the hard first cleaning member 131 can be embedded into the carpet fluff during cleaning of the soft surface such as the carpet.

The roller brush (having the three cleaning members above arranged in sequence and provided with the cyclone groove 2, which may refer to the roller brush in FIG. 2*a*) of this example is utilized, the three cleaning members are assembled to the vacuum cleaner in the aforementioned arrangement mode of the three cleaning members, and a test of a dust suction effect is performed.

Meanwhile, comparative examples are set.

Comparative example 1 is a roller brush adopting a soft bristle brush and a hard bristle brush staggered at equal intervals.

Comparative example 2 is a roller brush adopting single velvet brush strips, which is tested respectively on the floor and a long-fluff carpet.

Comparative example 3 is a roller brush without a cyclone groove in Example 1 of the present disclosure.

Figure 10:
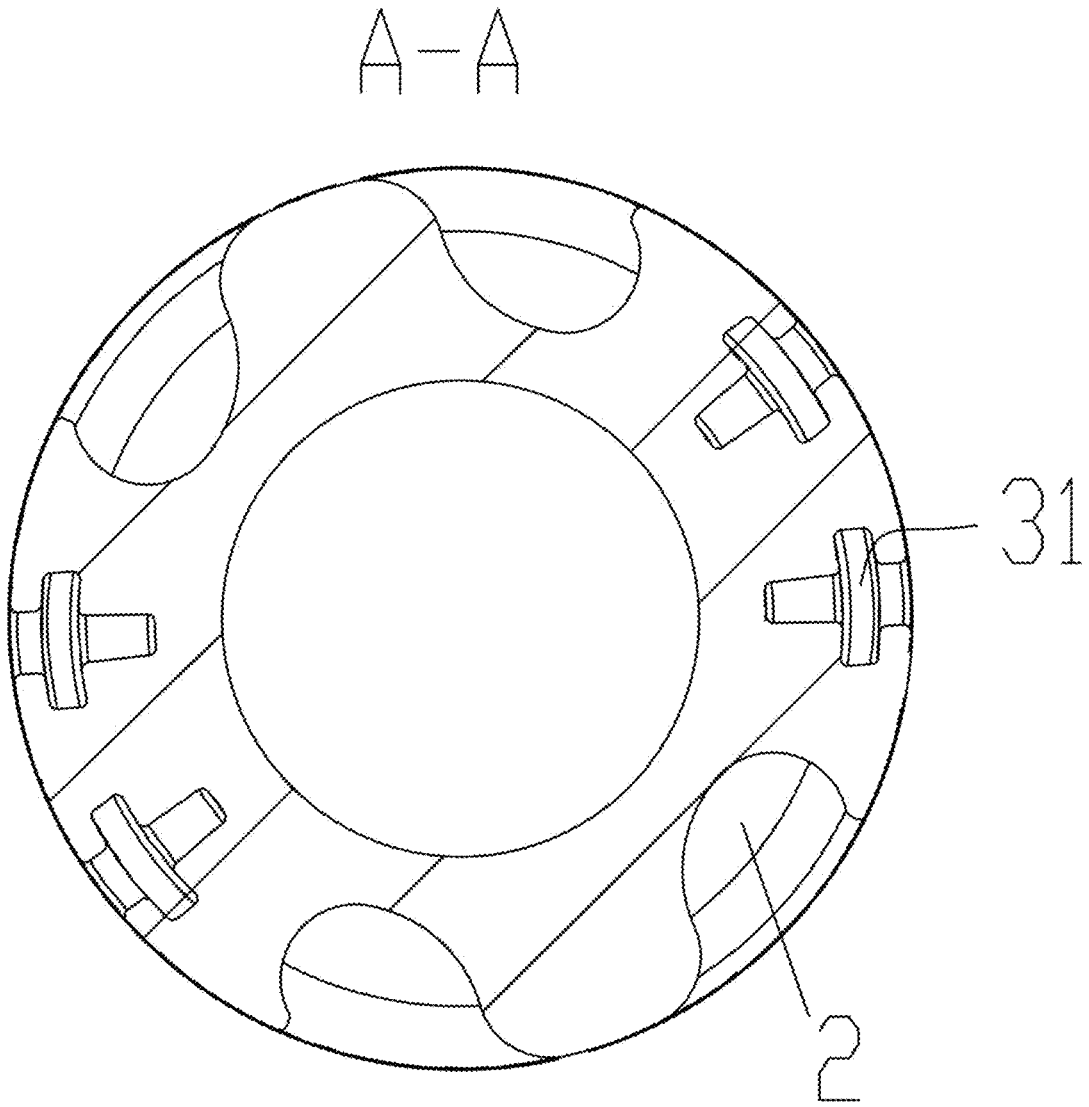
FIG. 10 is a structural sectional view of a section perpendicular to a central axis of a roller brush in Comparative example 4 of Table 1.

Comparative example 4 is a structure with the additionally arranged cyclone groove on the basis of Comparative example 1. FIG. 10 is a structural sectional view of a section of the roller brush of Comparative example 4 perpendicular to a central axis of the roller brush, in which only leather strips and the soft bristles are arranged on the roller brush, a leather strip and a soft bristle adjacent to each other are used as one group, but a space d between the leather strip and the soft bristle in any group is greater than 18 mm, and a structure of the cyclone groove is arranged.

Comparative example 5 is to replace the cleaning members in Comparative example 4 with equal-height hard bristles and leather strips, in which the structure of the cyclone groove is arranged.

A result is shown in Table 1. A dust suction ratio in Table 1 refers to that an amount of a dust sample before dust suction is set as 50 g in the test, after the dust suction treatment, a weight x of the dust sucked away by the vacuum cleaner is weighed, and the dust suction ratio is equal to $(x/50)\times100\%$. In the test, soybeans, large-particle cat litter and corn flour are selected as "dust samples" respectively. During calculation of a hair suction ratio, 50 g of corn flour mixed with 5 g of hair is used as the dust sample for the test; and the hair suction ratio refers to that an amount of a hair sample before hair suction is set as 5 g in the test, after the dust suction treatment, a weight y of the hair sucked away by the vacuum cleaner is weighed, and the hair suction ratio is equal to $(y/5)\times100\%$. In the test, single hair with a length being 30 cm or above is used as the "hair sample".

TABLE 1

Comparison of dust suction effects of Comparative examples and the roller brush of the present disclosure

| | | Dust suction ratio (%) | | | Hair suction ratio (%) |
|---|---|---|---|---|---|
| | | Soybeans | Large particle cat litter | Corn flour | Corn flour 50 g + Hair 5 g |
| Example 1 | Floor | 96.7 | 98.1 | 96.3 | 98.0 |
| | Long-fluff carpet | 88.6 | 99.1 | 98.0 | 95.6 |
| Example 2 | Floor | 96.1 | 97.8 | 95.2 | 97.5 |
| | Long-fluff carpet | 87.3 | 99.1 | 96.7 | 95.2 |
| Example 3 | Floor | 97.1 | 99.0 | 96.9 | 100.0 |
| | Long-fluff carpet | 89.2 | 99.0 | 98.9 | 97.6 |
| Comparative example 1 | Floor | 75.0 | 95.8 | 75.3 | — |
| | Long-fluff carpet | 64.4 | 79.8, the floor brush is stuck | 92.3 | — |
| Comparative example 2 | Floor | 80.0 | 97.2 | 81.7 | — |
| | Long-fluff carpet | 73.2, the floor brush is stuck and cannot move substantially | 84.6, the floor brush is stuck and cannot move substantially | 69.7, the floor brush is stuck and cannot move substantially | — |
| Comparative example 3 | Floor | — | — | — | 65.8 |
| Comparative example 4 | Floor | — | — | — | 90.5 |
| | Long-fluff carpet | — | — | — | 83.6 |
| Comparative example 5 | Carpet | — | — | — | 87.8 |

It can be seen from the results of Table 1 that the examples of the present disclosure can achieve the effect of efficient dust removal on both the floor and the long-fluff carpet, and compared with the existing same type of vacuum cleaners, dust removal efficiency, especially the dust suction effect on the carpet, is improved in general. Meanwhile, due to cooperation of the cyclone groove 2, the suction effect on the mixed dirt of the dust and the hair is obviously better than the comparative examples, apparently, by adopting the arrangement mode of making the first cleaning slots 11 close to one another in the present disclosure and cooperation of the three cleaning members as well as the effect of the cyclone groove 2, the vacuum cleaner using the roller brush of the present disclosure is better in suction effect on the mixed dirt of the dust and the hair.

It can be seen from results of Comparative examples 4 and 5 in Table 1 that though the cyclone groove is formed in the roller brush, the hair suction effect is worse than the hair suction effect of the roller brush adopting the first cleaning member 131, the second cleaning member 132 and the third cleaning member 133 close to one another in Examples 1 to 3.

In some implementations, the roller brush in Examples 1 to 3 of the present disclosure is combined with a structure having a comb plate for scraping away the hair, and in Example 3, as only the third cleaning member is longer and can abut against the comb plate to scrape away the hair, whole work noise of the vacuum cleaner is quite low.

By making the space d between the first cleaning slots 11 arranged in the same group be 2 mm, 4 mm, 6 mm, 8 mm, 10 mm, 12 mm, 14 mm, 16 mm and 18 mm respectively for the examples, and making the space between the first cleaning slots 11 arranged in the same group be 19 mm and 21 mm for the comparative examples, the corn flour is used as to-be-sucked dust, and the test is performed on the floor and the long-fluff carpet respectively. In this test, a size of the adopted rolling brush is required that a diameter of an outer profile including the part with the cleaning members is 50 mm to 55 mm (this test is performed only using this size, but it does not mean that the present application only covers this size, namely, the diameter 50 mm to 55 mm of the whole outer profile of the rolling brush). The results are shown in Table 2 and it can be seen from the results in Table 2 that the space d is arranged without exceeding 18 mm, so it may be guaranteed that the vacuum cleaner maintains the good dust suction effect on both the floor and the long-fluff carpet, especially, the dust removal effect on the long-fluff carpet is obviously improved.

TABLE 2

Comparison of dust suction effects of the vacuum cleaner with different arrangement spaces d

| | Space d | Dust suction ratio (%) | |
|---|---|---|---|
| | (mm) | Floor | Long-fluff carpet |
| Example 1 | 2 | 99.1 | 93.3 |
| Example 2 | 4 | 99.5 | 94.2 |
| Example 3 | 6 | 99.7 | 95.3 |
| Example 4 | 8 | 99.7 | 95.1 |
| Example 5 | 10 | 99.6 | 94.8 |
| Example 6 | 12 | 99.1 | 94.3 |
| Example 7 | 14 | 98.5 | 93.7 |
| Example 8 | 16 | 97.6 | 92.5 |

TABLE 2-continued

Comparison of dust suction effects of the vacuum cleaner with different arrangement spaces d

| | Space d | Dust suction ratio (%) | |
|---|---|---|---|
| | (mm) | Floor | Long-fluff carpet |
| Example 9 | 18 | 97.1 | 92.1 |
| Comparative example 1 | 19 | 96.4 | 89.2 |
| Comparative example 2 | 21 | 95.1 | 88.7 |

Example 2

This example is a rolling brush, including the roller brush in Example 1, and a first cleaning member 131, a second cleaning member 132 and a third cleaning member 133 are arranged on each cleaning member mounting portion 1 of the roller brush in sequence.

In other possible implementations, each cleaning member mounting portion 1 may be not provided with first cleaning slots 11, the cleaning members are directly arranged on a surface of a roller brush substrate in the mode of Example 1, for example, arranged on the surface of the roller brush substrate in a mode of direct flocking or pasting.

Example 3

This example is a floor brush head, including the roller brush of Example 1.

Example 4

This example is a brush bristle structure, including a first cleaning member 131, a second cleaning member 132 and a third cleaning member 133 arranged in sequence, then the brush bristle structure is arranged on a roller brush, when the roller brush is in a rotating state, the three cleaning members of each group of cleaning member mounting portion 1 sequentially rotate towards a to-be-cleaned surface respectively in an order of the first cleaning member 131, the second cleaning member 132 and the third cleaning member 133, the first cleaning member 131 is a hard brush bristle cleaning member, and the second cleaning member 132 is a strip-shaped cleaning member. For example, it may be leather strips, cloth strips or other sheet-shaped or strip-shaped cleaning members with certain compact surfaces, the third cleaning member 133 is a soft brush bristle cleaning member, and a hardness of brush bristles of the third cleaning member 133 is less than a hardness of brush bristles of the first cleaning member 131.

In some implementations, the height of the first cleaning member 131 is less than the height of the second cleaning member 132, and the height of the third cleaning member 133 may be greater than or equal to the height of the second cleaning member 132. In other possible implementations, the height of the first cleaning member 131 may also be equal to the height of the second cleaning member 132 but less than the height of the third cleaning member 133.

As a length of the first cleaning member 131 of the present disclosure is smaller and its hardness is higher, during cleaning of a hard surface (such as the floor), the first cleaning member 131 does mot scratch a to-be-cleaned surface, and thus the floor brush roller of the present disclosure may directly clean the hard surface without replacing the floor brush head or the cleaning members.

Meanwhile, during cleaning of the hard surface, if the ground is uneven and the second cleaning member 132 is the strip-shaped cleaning member, gaps between the cleaning member and the ground are formed, so a cleaning blank area is caused, or a cleaning effect is affected. In this case, the cleaning effect is further achieved under the action of the third cleaning member 133.

In some implementations, the first cleaning member 131, the second cleaning member 132 and the third cleaning member 133 are close to one another. Therefore, during cleaning of a soft surface such as a carpet, the first cleaning member 131 with a hard texture is first embedded into the carpet and can scrabble sundries such as dust in the carpet, further, the sundries are fully scraped away directly under the action of the second cleaning member 132 close to the first cleaning member 131 and sucked away via a suction opening of the vacuum cleaner, and meanwhile, the scrabbled dust is just filled in a containing space formed by the second cleaning member 132 and the carpet or the ground, and then taken away under rotation of the second cleaning member 132. Meanwhile, the present disclosure uses soft bristles of the third cleaning member 133 close to the second cleaning member 132, fluff of the carpet pressed by the first cleaning member 131 and the second cleaning member 132 in a cleaning process may be recovered to a fluffy effect under flapping of the soft bristles of the third cleaning member 133 (see FIG. 8*c*), and meanwhile, the third cleaning member 133 is soft brush bristles and can play a cleaning effect again.

In some implementations, the first cleaning member 131, the second cleaning member 132 and the third cleaning member 133 are respectively arranged in the three first cleaning slots 11 separated from one another.

In other possible implementations, at least one cleaning member may also be directly arranged on a surface of the roller brush substrate, for example, by using a flocking mode or directly clamping the cleaning member to the surface of the roller brush substrate.

In other possible implementations, at least two cleaning members may also be integrated onto the same base material, when the cleaning members are arranged on the roller brush substrate, the first cleaning slots 11 in each group arranged in group may contain only two, and the first cleaning slot 11 integrated with the two cleaning members may be arranged wider correspondingly.

Example 5

This example is a vacuum cleaner, including the roller brush in Example 1 or the rolling brush in Example 2 or the floor brush head in Example 3 or the brush bristle structure in Example 4.

The aforementioned implementations are only for explaining the technical concept and the features of the present disclosure and are intended to make those familiar with this technology understand and implement the contents of the present disclosure but not to limit the protection scope of the present disclosure, and equivalent variations or modifications made according to the spirit essence of the present disclosure are to be covered within the protection scope of the present disclosure.

The invention claimed is:

1. A roller brush, comprising a roller brush substrate (12), at least one cleaning member mounting portion (1) being arranged on the roller brush substrate (12), each cleaning member mounting portion (1) comprising at least one group of first cleaning slots (11) arranged in group, and the first cleaning slots (11) being configured to arrange cleaning members, wherein the number of the first cleaning slots (11) in each group arranged in group is at least three, the first cleaning slots (11) in each group are close to one another, a space d between slot walls close to each other of any two adjacent first cleaning slots (11) in each group does not exceed 18 mm, in the case that the number of groups of first cleaning slots (11) is one, an angle difference β between central axes of any two adjacent first cleaning slots (11) in each group of first cleaning slots (11) arranged in group on a circumferential surface located on the same cylinder using a central axis of the roller brush substrate (12) as a circle center is less than 360/n, wherein n is the number of the first cleaning slots (11) in each group arranged in group, and in the case that the number of groups of first cleaning slots (11) is greater than or equal to two, an angle difference α between two first cleaning slots (11) close to each other of any two adjacent groups of first cleaning slots (11) is greater than the angle difference β between the two first cleaning slots (11) close to each other in each group.

2. The roller brush according to claim 1, wherein at least one cyclone groove (2) is further formed in a surface of the roller brush substrate (12), at least one of two first cleaning slots (11) located on an outermost side in each group of first cleaning slots (11) is adjacent to the cyclone groove (2), an internal groove wall of one side of the cyclone groove (2) away from the central axis a of the roller brush substrate (12) is a large-diameter groove wall (21), an internal groove wall of one side of the cyclone groove (2) close to the central axis a is a small-diameter groove wall (22), and a distance D between cylindrical surfaces on which the large-diameter groove wall (21) and the small-diameter groove wall (22) are located along a section perpendicular to a and in a radial direction of the roller brush substrate (12) is greater than 2 mm.

3. The roller brush according to claim 2, wherein two sides of the two first cleaning slots (11) on the outermost side in each group of first cleaning slots (11) are each provided with one cyclone groove (2), and the large-diameter groove wall (21) is arranged on one side close to the first cleaning slot (11) adjacent to the large-diameter groove wall.

4. The roller brush according to claim 1, further comprising at least one group of second cleaning portion (3), each group of second cleaning portion (3) comprising two second cleaning slots (31) distributed on the roller brush substrate (12) at an angle difference of 180 degrees, and a distance between the second cleaning slots (31) and the first cleaning slots (11) close to the second cleaning slots (31) being greater than a distance between two adjacent first cleaning slots (11) in each group arranged in group.

5. The roller brush according to claim 2, further comprising at least one group of second cleaning portion (3), each group of second cleaning portion (3) comprising two second cleaning slots (31) distributed on the roller brush substrate (12) at an angle difference of 180 degrees, and a distance between the second cleaning slots (31) and the first cleaning slots (11) close to the second cleaning slots (31) being greater than a distance between two adjacent first cleaning slots (11) in each group arranged in group.

6. The roller brush according to claim 3, further comprising at least one group of second cleaning portion (3), each group of second cleaning portion (3) comprising two second cleaning slots (31) distributed on the roller brush substrate (12) at an angle difference of 180 degrees, and a distance between the second cleaning slots (31) and the first cleaning slots (11) close to the second cleaning slots (31) being greater than a distance between two adjacent first cleaning slots (11) in each group arranged in group.

7. The roller brush according to claim 1, wherein protrusions (4) protruding outwards away from a surface of the roller brush substrate (12) are further arranged between any two groups of first cleaning slots (11).

8. The roller brush according to claim 1, wherein the number of groups of first cleaning slots (11) is an even number, every two groups of first cleaning slots (11) with an angle difference being 180 degrees in a circumferential direction of the roller brush substrate (12) form a cleaning unit, and at least one cleaning unit is arranged on the roller brush substrate (12).

9. A floor brush head, comprising the roller brush according to claim 1, at least one type of cleaning members being capable of being arranged in each first cleaning slot (11), and the cleaning member extending from one end towards the other end in a length direction of a roller brush substrate (12).

10. A floor brush head, comprising the roller brush according to claim 2, at least one type of cleaning members being capable of being arranged in each first cleaning slot (11), and the cleaning member extending from one end towards the other end in a length direction of a roller brush substrate (12).

11. A floor brush head, comprising the roller brush according to claim 3, at least one type of cleaning members being capable of being arranged in each first cleaning slot (11), and the cleaning member extending from one end towards the other end in a length direction of a roller brush substrate (12).

12. A floor brush head, comprising the roller brush according to claim 4, at least one type of cleaning members being capable of being arranged in each first cleaning slot (11), and the cleaning member extending from one end towards the other end in a length direction of a roller brush substrate (12).

13. A floor brush head, comprising the roller brush according to claim 7, at least one type of cleaning members being capable of being arranged in each first cleaning slot (11), and the cleaning member extending from one end towards the other end in a length direction of a roller brush substrate (12).

14. A floor brush head, comprising the roller brush according to claim 8, at least one type of cleaning members being capable of being arranged in each first cleaning slot (11), and the cleaning member extending from one end towards the other end in a length direction of a roller brush substrate (12).

15. The floor brush head according to claim 14, wherein three cleaning members are arranged on a cleaning member mounting portion (1) and are a first cleaning member (131), a second cleaning member (132) and a third cleaning member (133) in sequence, and in the case that the roller brush is in a rotating state, the three cleaning members arranged on each group of cleaning member mounting portion (1) sequentially rotate towards a to-be-cleaned surface respectively in an order of the first cleaning member (131), the second cleaning member (132) and the third cleaning member (133).

16. The floor brush head according to claim 15, wherein the first cleaning member (131) is a hard brush bristle cleaning member, the second cleaning member (132) is a strip-shaped cleaning member, the third cleaning member (133) is a soft brush bristle cleaning member, a hardness of brush bristles of the third cleaning member (133) is less than a hardness of brush bristles of the first cleaning member (131), and a height of the third cleaning member (133) is equal to or greater than a height of the second cleaning member (132) in the case that a height of the first cleaning member (131) is less than the height of the second cleaning member (132); and the height of the third cleaning member (133) is greater than the height of the second cleaning member (132) in the case that the height of the first cleaning member (131) is equal to the height of the second cleaning member (132).

17. A vacuum cleaner, comprising the floor brush head according to claim 9.

18. A vacuum cleaner, comprising the floor brush head according to claim 12.

19. A vacuum cleaner, comprising the floor brush head according to claim 14.

20. A vacuum cleaner, comprising the floor brush head according to claim 15.

* * * * *